US008887613B1

(12) United States Patent
Griffin et al.

(10) Patent No.: US 8,887,613 B1
(45) Date of Patent: Nov. 18, 2014

(54) PIN RETAINER ON A MISSILE LAUNCH RAIL

(71) Applicant: The United States of America as Represented by the Secretary of the Army, Washington, DC (US)

(72) Inventors: Brittany C. Griffin, Madison, AL (US); Jeremy A. Belcher, Huntsville, AL (US); Justin R. Harrison, Madison, AL (US); Brock Birdsong, Pulaski, TN (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/041,448

(22) Filed: Sep. 30, 2013

(51) Int. Cl.
*F41F 3/04* (2006.01)

(52) U.S. Cl.
CPC ..... *F41F 3/0406* (2013.01)
USPC ..... 89/1.806; 89/1.812

(58) Field of Classification Search
CPC ..... F41F 3/0406
USPC ..... 89/1.8–1.819
See application file for complete search history.

(56) References Cited

U.S. PATENT DOCUMENTS

| | | | | | |
|---|---|---|---|---|---|
| 3,842,711 | A | * | 10/1974 | Bodinaux | 89/1.807 |
| 4,031,805 | A | * | 6/1977 | Puttinger et al. | 89/1.58 |
| 4,393,745 | A | * | 7/1983 | Mayo et al. | 89/1.806 |
| 4,685,377 | A | * | 8/1987 | Mace et al. | 89/1.54 |
| 5,148,734 | A | * | 9/1992 | Lilly | 89/1.815 |
| 5,714,708 | A | | 2/1998 | Shim et al. | |
| 8,353,238 | B1 | * | 1/2013 | Montgomery et al. | 89/1.811 |
| 2011/0265637 | A1 | | 11/2011 | Hainze et al. | |

* cited by examiner

*Primary Examiner* — Michelle R Clement
(74) *Attorney, Agent, or Firm* — William Bradley Haymond

(57) ABSTRACT

The application relates to a missile launch rail device including: a missile launch rail and a latch for attaching and releasing a missile situated on the missile launch rail, a latch pin inserted through both two latch pin holes and two rail pin holes positioned approximately halfway between the cam end and the spring end and a pin retainer securely mounted to the missile launch rail, the pin retainer including a latch pin catch which holds the latch pin in place to restrict radial pressure by the pin on inside surfaces of the two latch holes and inside surfaces of the two rail pin holes from pressure created by the missile on the latch, thus substantially preventing premature disabling of the missile launch rail and the latch by wear on the latch holes and the rail pin holes.

8 Claims, 4 Drawing Sheets

PIN RETAINER ON A MISSILE LAUNCH RAIL

BACKGROUND

1. Field of the Invention

A missile launch rail experiences a harsh environment that produces many stresses in the material. This subsequently results in fatigue failures. These stresses can be caused by vibration, bending, and overuse. When failures occur in the form of cracks in the latch pinholes or rail pinholes, catastrophic failures such as a hang fire can occur.

2. Discussion of the Background

The missile launch rail was designed for a finite life measured in missile firings and captive carry vibration hours. The hours and firings needed to be monitored and tracked so that the missile launch rail could be replaced on time. Tracking the life of the rails in combat has proved to be difficult and unfeasible.

When catastrophic failures on a missile launch rail have been discovered, two assumptions have been made about the causes of the cracking: a) there was a coupled vibration between the missile launch rail and the missile, and b) equipment on both the missile and the missile launch rail was stressed.

Several solutions were considered to address the rail pin hole and/or latch pin hole crack. A redesign of the rail would be costly and time consuming. The cracking needs to be addressed quickly because of the missile launch rails currently in use by the Army. Currently, the missile launch rails are being inspected using Non-Destructive Inspection (NDI) methods, but in order for NDI methods to find all of the rail pin hole and/or latch pin hole cracks the rails must be disassembled. The disassembly causes the inspection to be time consuming and costly. A solution for missile launch rail cracking is an immediate issue.

In FIG. 1 (Prior Art), the existing missile launch rail latch technology does not have a failsafe in the event of a failure. The rail pin holes 132 in the missile launch rail 110 are very close to the edge of the rail 110, thus not adhering to sound engineering principles. The missile launch rail 110 holds the missile in place and supports and secures the components of the latch 114. The latch pin 112 inserted through the rail pin holes 132 in the missile launch rail 110 and the latch pin holes 134 in the latch 114 provides the pivot for the latch 114 as the latch 114 moves with the missile. The latch 114 is the mechanism that holds the missile on the missile launch rail 110. The latch handle 116 allows for controlling the latching and unlatching of the missile. The latch cam shaft 118 positions the latch 114 in the latched or unlatched configuration according to whether the flat side 140 or the rounded side 142 of the latch cam shaft 118 is under the cam end 136 of the latch 114. The latch spring 120 provides tension under the latch 114 at the spring end 138 of the latch 114 as the spring end 138 is pushed down on the latch spring 138.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 2:
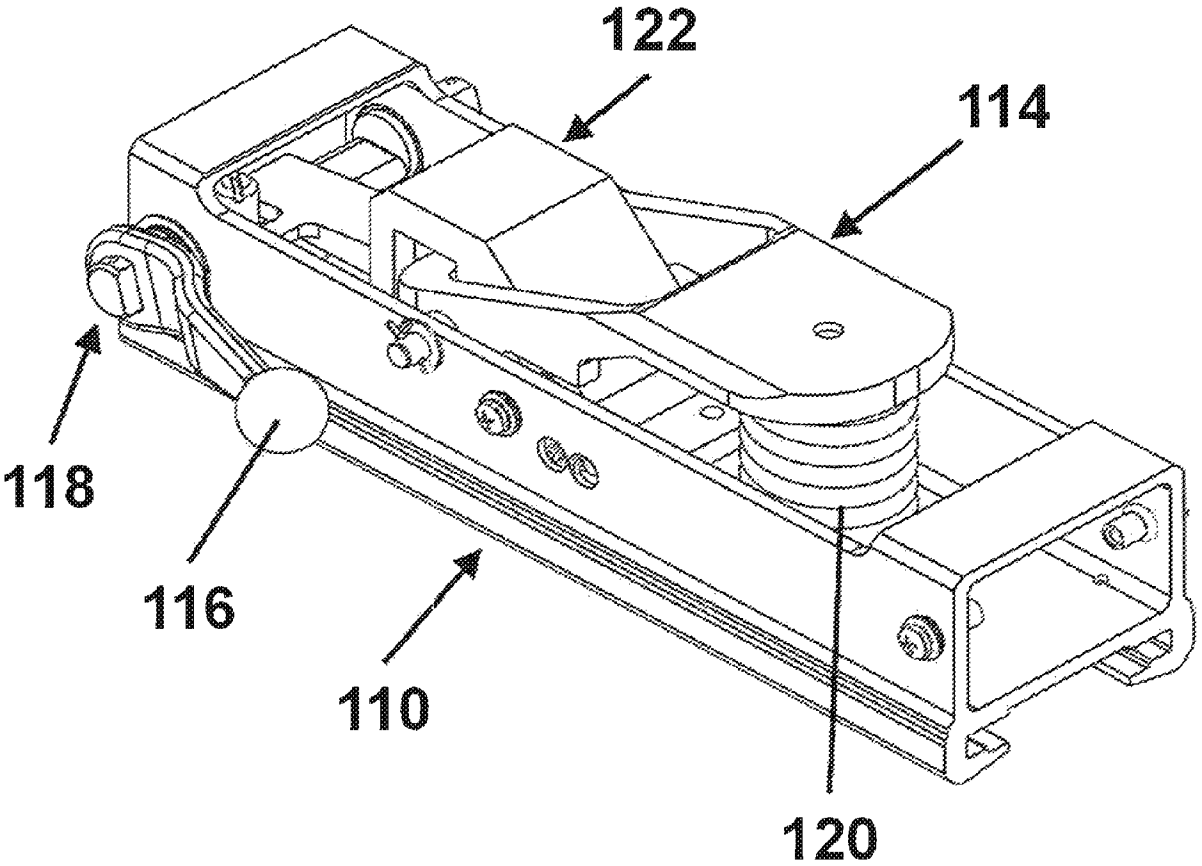
FIG. 2 shows a perspective drawing of a missile launch rail implementing the pin retainer of the present application into the launch rail.

Referring to FIG. 2, the present application discloses a missile launch rail 110 with a pin retainer 122 being used to prevent catastrophic failures in a missile launch rail 110. The pin retainer 122 is mounted to the missile launch rail 110 and holds in place and reinforces the latch pin during regular use of the missile launch rail.

The present application can be used on existing and future missile launchers developed by or for the Army for use in combat.

The present application provides a simple and cost effective solution to the safety and reliability issues of missile launch rail 110 cracking, specifically cracking of the rail pin holes 132 and/or latch pin holes 134. The existing technology is being used longer than expected. When the failures occur, there is a serious safety issue. The present application provides a failsafe in case of a failure of the rail pin holes 132 and/or latch pin holes 134. The present application can be implemented quickly and cost effectively into existing missile launch rails 110.

The present application gives a solution that substantially decreases the problem of missile launch rail 110 cracking.

As shown in FIG. 2, the present application starts with a missile launch rail 110 and adds a pin retainer 122 located to prevent catastrophic failures, such as specifically a crack or cracks in a rail pin hole 132. The missile launch rail 110 holds the missile in place and supports latch components. The latch pin 112 (hidden by the pin retainer 122) provides the pivot for the latch 114. The latch 114 is the mechanism that holds the missile on the missile launch rail 110. The latch handle 116 allows for latching and unlatching of the missile. The latch cam shaft 118 positions the latch 114 in the latched or unlatched configuration. The latch spring 120 provides tension on the latch 114. The pin retainer 122 provides failsafe in the event of a failure of the latch pin 112 on the missile launch rail 110.

Figure 3:
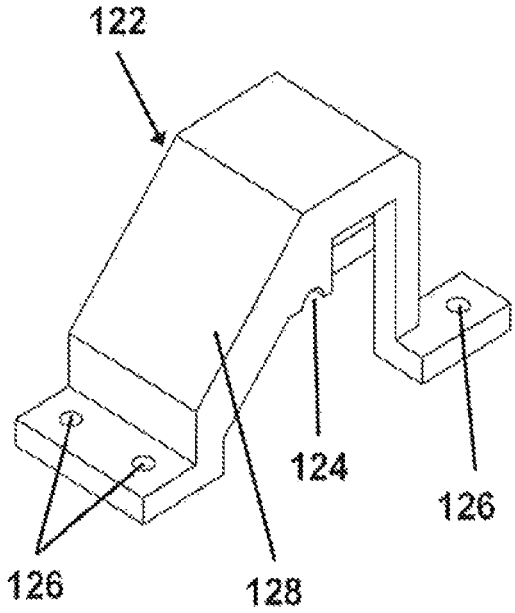
FIG. 3 shows a perspective drawing of the retaining end of the pin retainer of the present application.
Figure 4:
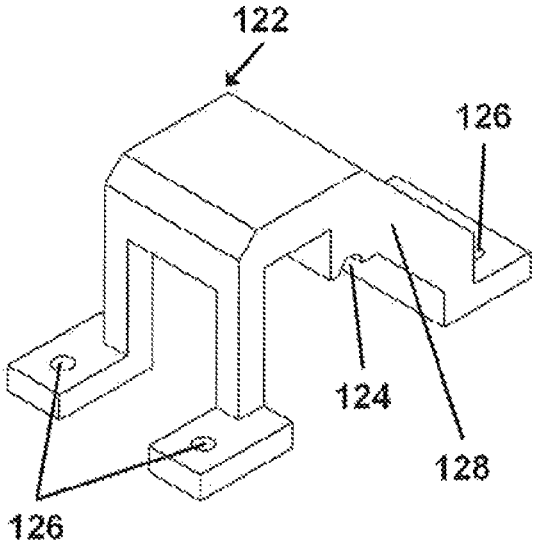
FIG. 4 shows a perspective drawing of the back end of the pin retainer of the present application.

The specific components of the pin retainer 122 are shown in front and back view perspectives, respectively, in FIGS. 3 and 4. FIG. 3 shows a perspective drawing of the retaining end of the pin retainer 122 of the present application. FIG. 4 shows a perspective drawing of the back end of the pin retainer 122 of the present application. Both the retaining end and the back end can have a width of from 1.0 to 2.5 inches. The components of the pin retainer 122 include: the latch pin catch 124 which holds the latch pin 112 in place; the body 128 of the pin retainer 122, which supports and secures the pin retainer 122 to the missile launch rail 110; and the mounting holes 126 in the body 128, which enable the mounting of the pin retainer 122 to the missile launch rail 110. The pin retainer 122 from top to bottom can have a height of from 1.5 to 3.0 inches. Furthermore, the pin retainer 122 can have a length from the front of the retaining end to the back of the back end of from 3.0 to 4.5 inches. The portion of the missile launch rail 110 on which the pin retainer 122 is mounted needs to be of adequate thickness to support the loading of the pin retainer 122 exerted by the latch pin 112.

Figure 1:
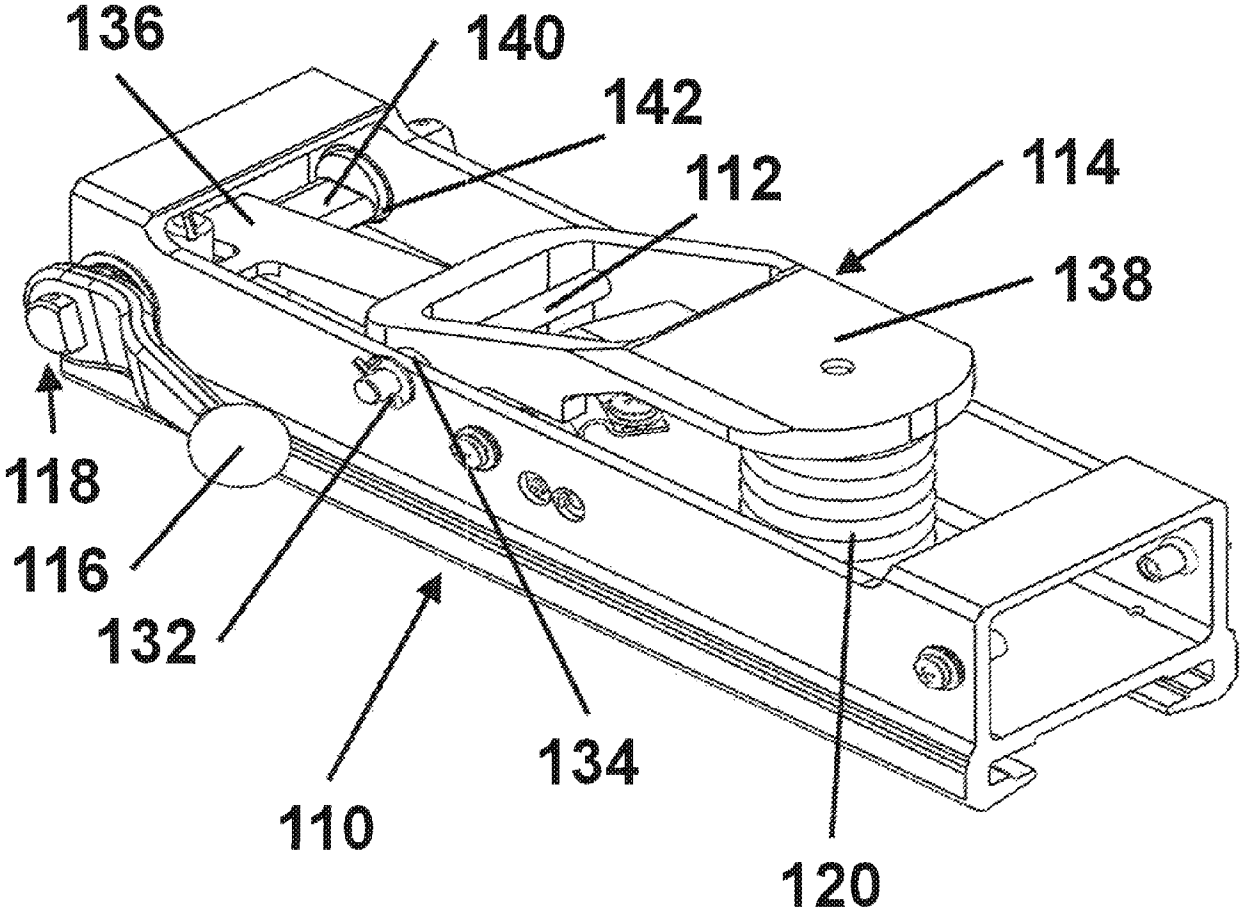
Figure 1 PRIOR ART
FIG. 1 shows a perspective drawing of a prior art version of a missile launch rail with conventional launch rail latch technology.
Figure 5:
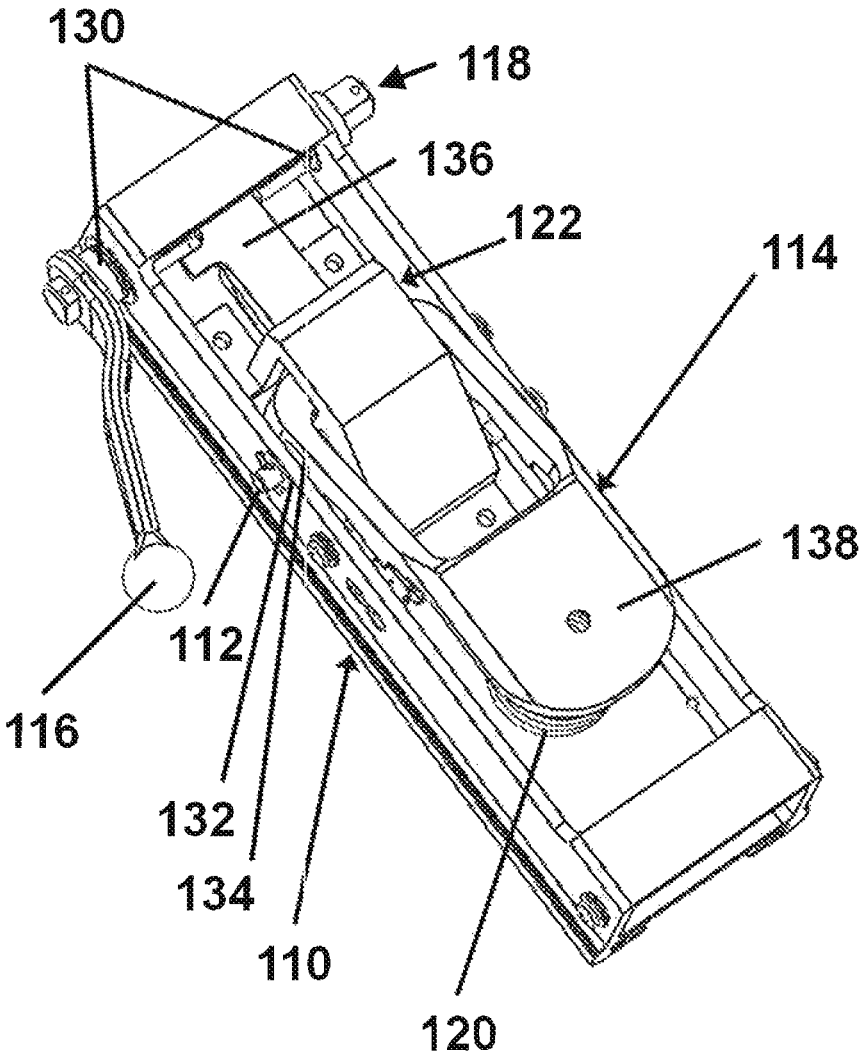
FIG. 5 shows a close-up view from above a missile launch rail with the pin retainer of the present application attached to the missile launch rail.

A top view of the missile launch rail 110 with the pin retainer 122 attached is shown in FIG. 5. The missile launch rail 110 supports and secures the components of the latch 114. As shown, besides the latch 114 itself, which includes the spring end 138 and the cam end 136, the components of the latch 114 include the latch pin 112 (hidden by the pin retainer 122), the latch cam shaft 118, the latch spring 120, and the pin retainer 122. The components of the pin retainer 122 are pictured in detail in FIGS. 3 and 4. The latch 114 includes a cam end 136 and a spring end 138. The missile launch rail 110 includes cam shaft holes 130 located one on each side of the missile launch rail 110 near the cam end 136 of the latch 114. The cam end 136 of the latch 114 is situated directly above the latch cam shaft 118. The latch cam shaft 118 has two ends with each end being inserted through one of the two cam shaft holes 130 respectively in the missile launch rail 110. The missile launch rail 110 also includes rail pin holes 132 located on each side of the missile launch rail 110. The rail pin holes 132 are located approximately halfway between the cam end 136 and the spring end 138. The two rail pin holes 132 are positioned to each hold an end of the latch pin 112. Each of the ends of the latch pin 112 is inserted through one of the two rail pin holes 132 respectively. The latch 114 also includes latch pin holes 134 on opposite sides of the latch 114 which are also approximately halfway between the cam end 136 and the spring end 138. Each of the two latch pin holes 134 is positioned to line up with a corresponding one of the two rail pin holes 132. By this means, each end of the latch pin 112 is inserted through one of the two latch pin holes 134 and one of the two rail pin holes 132 lined up together. The latch cam shaft 118 is rotatable in the two cam shaft holes 130. Rotation of the latch cam shaft 118 is by pulling the latch cam shaft handle 116 up or down, which causes the cam end 136 of the latch 114 to alternate between latched or released mode. The latched or released mode is determined according to whether the at least one flattened side 140 or the at least one rounded side 142 (as pictured in FIG. 1) of the latch cam shaft 118 is positioned under the cam end 136 of the latch 114.

The present application relates to a missile launch rail device including (but not limited to) the following components.

One of the components is a missile launch rail 110 providing a protected rectangular space in which is secured a latch 114 for attaching and releasing a missile situated on the missile launch rail 110. The latch 114 includes a cam end 136 and a spring end 138. The missile launch rail 110 includes cam shaft holes 130 located one on each side of the missile launch rail 110 on the cam end 136 of the latch 114. The cam end 136 of the latch 114 is situated on top of a latch cam shaft 118. The latch cam shaft 118 has two ends with each end being inserted through one of the two cam shaft holes 130 respectively. The missile launch rail 110 also includes two rail pin holes 132, one located on each side of the missile launch rail 110. The rail pin holes 132 are located approximately halfway between the cam end 136 and the spring end 138. Each of the two rail pin holes 132 is positioned to hold one end of a latch pin 112. Each of the ends of the latch pin 112 is inserted through one of the two rail pin holes 132 respectively.

Another of the components is the latch 114 for attaching and releasing the missile on the missile launch rail 110. The latch 114 includes the cam end 136 under which a latch cam shaft 118 is perpendicularly positioned under the cam end 136 of the latch 114. The latch 114 also includes the spring end 138 opposite the cam end 136. The spring end 138 is positioned on top of a latch compression spring 120. The latch 114 also includes latch pin holes 134 on opposite sides of the latch 114 approximately halfway between the cam end 136 and the spring end 138. Each of the two latch pin holes 134 is lined up with the two rail pin holes 132. Each end of the latch pin 112 is inserted through one of the two latch pin holes 134 and one of the two rail pin holes 132 respectively.

Yet another of the components is the latch cam shaft 118 including at least one flattened side 140 and at least one rounded side 142 extending along the cam shaft length 118. Each end of the latch cam shaft 118 is inserted through one of two cam shaft holes 130 respectively in the missile launch rail 110 and positioned at the cam end 136 of the latch 114. The latch cam shaft 118 is rotatable in the two cam shaft holes 130. Rotation of the latch cam shaft 118 by lifting the latch handle 116 attached to the cam shaft 118 up or down causes the cam end 136 of the latch 114 to alternate between latched or released mode. Alternation between latched or released modes is determined by whether the at least one flattened side 140 or the at least one rounded side 142 of the latch cam shaft 118 is positioned under the cam end 136 of the latch 114.

Still another of the components is the latch compression spring 120 with a bottom end attached to the floor of the missile launch rail 110 and a top end providing tension to the spring end 138 of the latch 114. The tension is provided as the spring end 138 is pushed down on the top end of the latch compression spring 120. Alternatively, the tension is released on the spring end 138 as the spring end 138 is pulled up from the top end of the latch compression spring 120 according to the rotation of the latch cam shaft 118 which causes the latch 114 to latch the missile or release the missile respectively.

Another of the components is the latch pin 112 inserted through both the two latch pin holes 134 and the two rail pin holes 132 which are positioned with relation to the latch 114 approximately halfway between the cam end 136 and the spring end 138. The latch pin 112 functions to pivot the latch 114 as the missile is latched or released with relation to the missile launch rail 110. The latching or releasing functions according to whether the spring end 138 of the latch 114 is pushed down on the latch compression spring 120 because the cam shaft rounded side 142 is directly under the cam end 136, or whether the spring end 138 is pulled up on the latch compression spring 120 because the cam shaft flattened side 140 is directly under the cam end 136.

Yet another of the components is a latch handle 116 to manually control rotation of the latch cam 118. The latch handle 116 is perpendicularly fastened to one end of the latch cam 118 emerging from the missile launch rail 110. The latch handle 116 is operated by either pulling the latch handle 116 up to a vertical position to rotate the rounded side 142 up under the cam end 136 of the latch 114 and latch the missile into the launch rail 110, or pulling the latch handle 116 down to a horizontal position to rotate the flattened side 140 up under the cam end 136 of the latch 114 and unlatch the missile from the missile launch rail 110.

Still another component is a pin retainer 122 attached to the missile launch rail 110. The pin retainer 122 includes a latch pin catch 124 which holds the latch pin 112 in place to restrict radial pressure by the pin 112 on inside surfaces of the two latch pin holes 134 and inside surfaces of the two rail pin holes 132 from pressure created by the missile on the latch 114. By this means, premature disabling of the missile launch rail 110 and the latch 114 by wear on the latch pin holes 134 and the rail pin holes 132 is substantially prevented. The pin retainer 122 also includes a pin retainer body 128 with mounting holes 126 through which the pin retainer 122 is attached to the missile launch rail 110.

In one embodiment of the missile launch rail device, the pin retainer 122 is composed of materials selected from the group consisting of metal material, organic polymer-based synthetic material and combinations thereof.

In another embodiment of the missile launch rail device, the pin retainer 122 is from 1.5 to 3.0 inches in height, from 1.0 to 2.5 inches in width, from 3.0 to 4.5 inches in length.

In yet another embodiment of the missile launch rail device, the pin retainer 122 is mounted securely by driving bolts through the mounting holes 126 in the pin retainer body 128.

The present application relates to a method of preventing damage to a missile launch body 110 including (but not limited to) the following steps.

The first step is providing a missile launch rail 110 and a latch 114 secured to the missile launch rail 110. The latch 114 includes a cam end 136, a spring end 138, a latch pin 112, a latch cam shaft 118 and a latch compression spring 120. The missile launch rail 110 provides a protected rectangular space in which the latch 114 is secured. The latch 114 functions to attach or release a missile situated on the missile launch rail 110. The missile launch rail 110 includes two cam shaft holes 130 located on each side of the missile launch rail 110 at the cam end 136 of the latch 114 situated on top of the latch cam shaft 118. Each end of the cam shaft 118 is inserted through one of the two cam shaft holes 130 respectively. The cam shaft 118 is perpendicularly positioned underneath the cam end 136 of the latch 114. The spring end 138 of the latch 114 is opposite the cam end 136, the spring end 138 being positioned on top of the latch compression spring 120. The missile launch rail 110 also includes two rail pin holes 132 located on each side of the missile launch rail 110 approximately halfway between the cam end 136 and the spring end 138. The latch 114 also includes two latch pin holes 134 on opposite sides of the latch 114 and lined up with the two rail pin holes 132, approximately halfway between the cam end 136 and the spring end 138. Each end of the latch pin 112 is inserted through one of the two latch pin holes 134 and one of the two rail pin holes 132 respectively. The latch pin 112 functions to pivot the latch 114 as the latch cam shaft 118 causes the spring end 138 of the latch 114 to be pushed down or pushed up on the latch compression spring 120 to latch or unlatch the missile from the missile launch rail 110 respectively.

The second step is securely attaching a pin retainer 122 on the missile launch rail 110 to hold the latch pin 112 securely in place as the latch 114 rotates around the latch pin 112. The pin retainer 122 includes a pin retainer body 128 with mounting holes 126 and a latch pin catch 124, whereby the pin retainer 122 is mounted securely into the floor of the missile launch rail 110.

The third step is holding the latch pin 112 in place with the latch pin catch 124 of the latch pin retainer 122. The latch pin catch 124 severely limits movements of the pin 112 that cause pressure on inside surfaces of the two latch pin holes 134 and the two rail pin holes 134. The latch pin catch 124 of the latch pin retainer 122 thereby minimizes forces from the latch pin 112 on the rail pin holes 132 and the latch pin holes 134. These forces are associated with stationary missile vibrations as well as by vibrations and pressures caused by the launching of the missile. The pin retainer 122 thereby substantially minimizes premature disablement of the missile launch rail 110 and the latch 114.

In one embodiment of the method, the pin retainer 122 is composed of materials selected from the group consisting of metal material, organic polymer-based synthetic material, and combinations thereof.

In another embodiment of the method, the pin retainer 122 is from 1.5 to 3.0 inches in height, from 1.0 to 2.5 inches in width, and from 3.0 to 4.5 inches in length.

In yet another embodiment of the method, the pin retainer 122 is mounted securely by driving bolts through the mounting holes 126 in the pin retainer body 128.

To verify these methods and configurations, the following experiments were conducted and described in the Examples below.

EXAMPLE

Example

The first catastrophic failure on a missile launch rail was discovered in August 2011. After the development of the new prototype pin retainer, Oct. 9, 2012, simulations have been conducted to further prove the solution.

While several embodiments have been described in detail, it will be apparent to those skilled in the art that the disclosed embodiments may be modified. Therefore, the foregoing description is to be considered exemplary rather than limiting.

What is claimed is:

1. A missile launch rail device comprising;

a missile launch rail providing a protected rectangular space in which is secured a latch for attaching and releasing a missile situated on the missile launch rail, the latch including a cam end and a spring end, the missile launch rail including cam shaft holes located on each side of the missile launch rail on the cam end, the cam end of the latch being situated on top of a latch cam shaft, the latch cam shaft having two ends with each end being inserted through one of the two cam shaft holes respectively; the missile launch rail also including two rail pin holes located on each side of the missile launch rail, the rail pin holes located approximately halfway between the cam end and the spring end, each of the two rail pin holes being positioned to hold one end of a latch pin, each of the ends of the latch pin being inserted through one of the two rail pin holes respectively;

the latch for attaching and releasing the missile on the missile launch rail, the latch including the cam end under which a latch cam shaft is perpendicularly positioned under the cam end of the latch; the latch also including the spring end opposite the cam end, the spring end positioned on top of a latch compression spring; the latch also including two latch pin holes on opposite sides of the latch approximately halfway between the cam end and the spring end, each of the two latch pin holes being lined up with the two rail pin holes, and both the two latch pin holes and the two rail pin holes being positioned to hold each end of a latch pin, each end of the latch pin being inserted through one of the two latch pin holes and one of the two rail pin holes respectively;

the latch cam shaft including at least one flattened side and at least one rounded side extending along the cam shaft length, each end of the latch cam shaft being inserted through one of two cam shaft holes respectively in the missile launch rail and positioned at the cam end of the latch and the latch cam shaft being rotatable in the two cam shaft holes, rotation of the latch cam shaft by lifting the latch handle attached to the cam shaft up or down causing the cam end of the latch to alternate between latched or released mode, alternation being determined by whether the at least one flattened side or the at least one rounded side of the latch cam shaft is positioned under the cam end of the latch;

the latch compression spring with a bottom end attached to the floor of the missile launch rail and a top end providing tension to the spring end of the latch as the spring end is pushed down on the top end of the latch compression spring or releasing tension on the spring end as the spring end is pulled up from the top end of the latch compression spring according to the rotation of the latch cam shaft which causes the latch to latch the missile or release the missile respectively;

the latch pin inserted through both the two latch pin holes and the two rail pin holes positioned with relation to the latch approximately halfway between the cam end and the spring end, the latch pin functioning to pivot the latch as the missile is latched or released with relation to the missile launch rail according to whether the spring end of the latch is pushed down on the latch compression spring because the cam shaft rounded side is directly under the cam end or whether the spring end is pulled up on the latch compression spring because the cam shaft flattened side is directly under the cam end;

a latch handle to manually control rotation of the latch cam, the latch handle being perpendicularly fastened to one end of the latch cam emerging from the missile launch rail and being operated by either alternately pulling the latch handle up to a vertical position to rotate the rounded side up under the cam end of the latch and latch the missile into the launch rail or pulling the latch handle down to a horizontal position to rotate the flattened side up under the cam end of the latch and unlatch the missile from the missile launch rail; and a pin retainer attached to the missile launch rail, the pin retainer including a latch pin catch which holds the latch pin in place to restrict radial pressure by the pin on inside surfaces of the two latch holes and inside surfaces of the two rail pin holes from pressure created by the missile on the latch, thus substantially preventing premature disabling of the missile launch rail and the latch by wear on the latch holes and the rail pin holes, the pin retainer also including a pin retaining body with mounting holes through which the pin retainer is attached to the missile launch rail.

2. The missile launch rail of claim 1, wherein the pin retainer materials are selected from the group consisting of metal material, organic polymer-based synthetic material and combinations thereof.

3. The missile launch rail of claim 1, wherein the pin retainer is from 1.5 to 3.0 inches in height, from 1.0 to 2.5 inches in width, and from 3.0 to 4.5 inches in length.

4. The missile launch rail of claim 1, wherein the pin retainer is mounted securely by bolts driven through the mounting holes in the pin retainer body.

5. A method of preventing damage to a missile launch rail comprising:

providing a missile launch rail and a latch secured to the missile launch rail, the latch including a cam end, a spring end, a latch pin, a latch cam shaft and a latch compression spring; the missile launch rail providing walls and a floor to form a protected rectangular space in which the latch is secured, the latch functioning to attach or release a missile situated on the missile launch rail, the missile launch rail including two cam shaft holes located on each side of the missile launch rail at the cam end of the latch situated on top of the latch cam shaft, where each end of the cam shaft is inserted through one of the two cam shaft holes respectively; the cam shaft being perpendicularly positioned underneath the cam end of the latch on the cam end; the spring end of the latch being opposite the cam end, the spring end being positioned on top of the latch compression spring; the missile launch rail also including two rail pin holes located on each side of the missile launch rail approximately halfway between the cam end and the spring end, the latch also including two latch pin holes on opposite sides of the latch and lined up with the two rail pin holes, approximately halfway between the cam end and the spring end, each end of the latch pin being inserted through one of the two latch pin holes and one of the two rail pin holes respectively; the latch pin being inserted through both the two latch pin holes and the two rail pin holes, the latch pin functioning to pivot the latch as the latch cam shaft causes the free end of the latch to be pushed down or pushed up on the latch compression spring to latch or unlatch the missile from the missile launch rail respectively;

attaching securely a pin retainer on the missile launch rail to hold the latch pin securely in place as the latch rotates around the latch pin; the pin retainer including a pin retainer body with mounting holes and a latch pin catch, whereby the pin retainer is mounted securely into the floor of the missile launch rail; and holding the latch pin in place with the latch pin catch, the latch pin catch severely restricting movements of the pin that cause pressure on inside surfaces of the two latch pin holes and the two rail pin holes, the latch pin catch of the latch pin retainer thereby minimizing forces from the latch pin on the rail pin holes and the latch pin holes, the forces being associated with stationary missile vibrations as well as pressures caused by launching of the missile, the pin retainer thereby substantially minimizing premature disablement of the missile launch rail and the latch.

6. The method of claim 5, wherein the pin retainer materials are selected from the group consisting of metal material, organic polymer-based synthetic material and combinations thereof.

7. The method of claim 5, wherein the pin retainer is from 1.5 to 3.0 inches in height, from 1.0 to 2.5 inches in width, and from 3.0 to 4.5 inches in length.

8. The method of claim 5, wherein the pin retainer is mounted securely by driving bolts through the mounting holes in the pin retainer body.

* * * * *